United States Patent [19]

Wolf

[11] 4,323,159

[45] Apr. 6, 1982

[54] MONITORING LIGHT SENSITIVE ELECTRONIC COMPONENTS

[75] Inventor: Peter Wolf, Edenvale, South Africa

[73] Assignee: Gunson S.A. (Proprietary) Limited, Johannesburg, South Africa

[21] Appl. No.: 89,363

[22] Filed: Oct. 30, 1979

[30] Foreign Application Priority Data

Oct. 31, 1978 [ZA] South Africa ..... 78/6121

[51] Int. Cl.[3] ..... B07C 5/342

[52] U.S. Cl. ..... 209/548; 209/576; 209/589; 209/546; 250/252

[58] Field of Search ..... 209/546, 548, 549, 576, 209/577, 589; 250/252

[56] References Cited

U.S. PATENT DOCUMENTS 3,082,871 3/1963 Duncan ..... 209/548
3,225,195 12/1965 Scherbatskoy ..... 250/252 X
3,880,750 4/1975 Butler et al. ..... 209/549
4,060,726 11/1977 Luitwieler et al. ..... 250/252
4,187,426 2/1980 Jordan ..... 250/252 X
4,212,397 7/1980 Bockelmann ..... 209/576 X

*Primary Examiner*—Joseph J. Rolla
*Attorney, Agent, or Firm*—Cushman, Darby & Cushman

[57] ABSTRACT

This invention relates to apparatus for continuously monitoring a light sensitive electronic component, forming part of a device for detecting light pulses of a specified character, the apparatus comprising a light source directing light through fiber optics at the component, the source being pulsed by a pulse generator which also sets an alarm monitor connected to operate a switch having its input taken to the component, the switch output being connected to a voltage sensor for resetting the alarm monitor if a signal received from the switch is above a predetermined minimum, the alarm monitor being adapted to activate an alarm if not reset.

12 Claims, 1 Drawing Figure

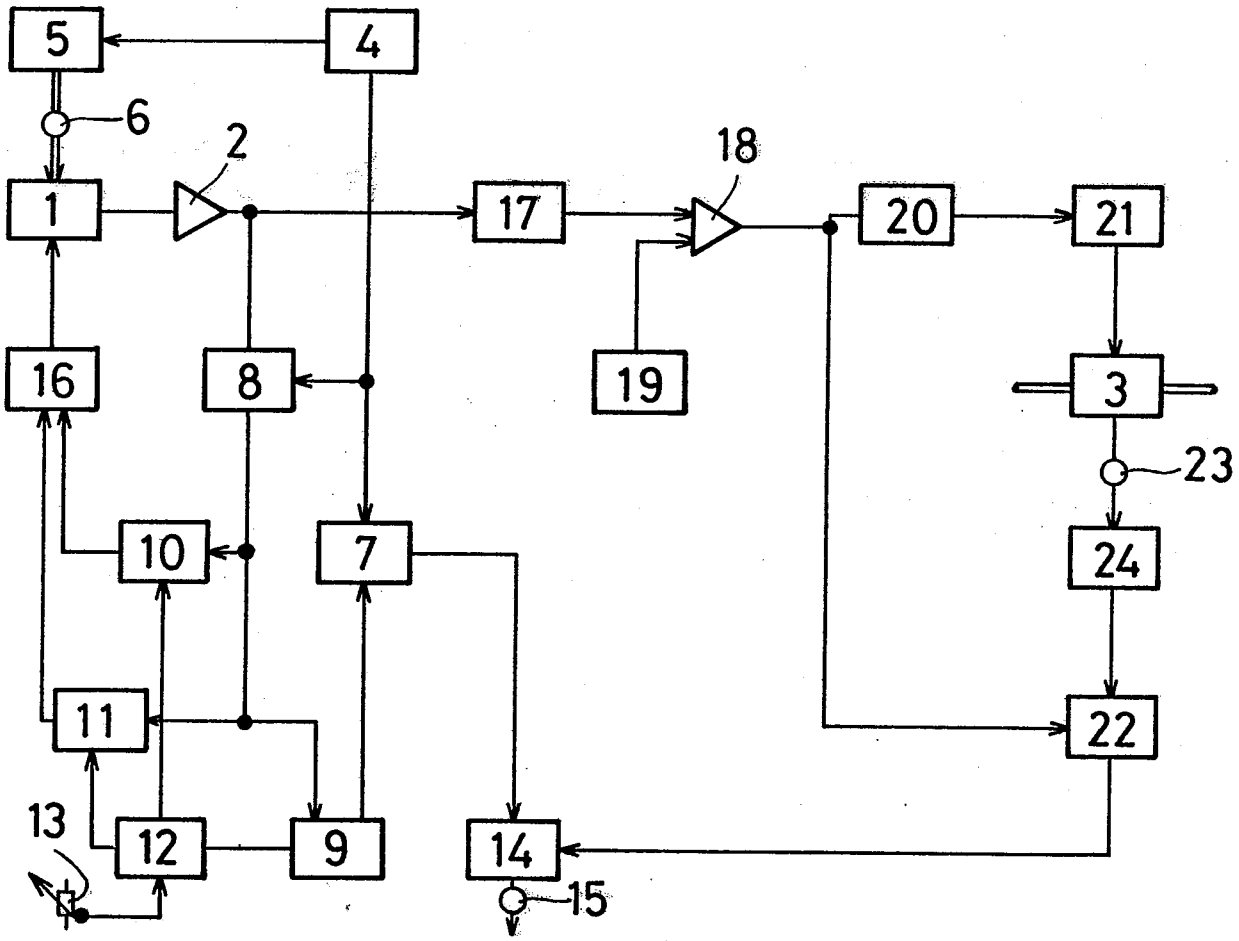
1
2
3
4
5
6
7
8
9
10
11
12
13
14
15
16
17
18
19
20
21
22
23
24

MONITORING LIGHT SENSITIVE ELECTRONIC COMPONENTS

This invention relates to the monitoring of electronic components which are sensitive to light and more particularly but not exclusively to photomultiplier tubes.

Description of the invention will be made with reference to a particular application of photomultiplier tubes. This application should not, however, be considered to restrict the scope of the invention in any way.

In certain diamond recovery techniques the diamonds are caused to fluoresce by excitation with x-radiation. This light is picked up by photomultiplier tubes which in turn activate a device which removes the diamond from the accompanying gangue material.

Like any other electronic components the photomultiplier tubes are subject to failure and must be checked periodically at relatively short intervals. Known methods of doing this involve stopping recovery for a short while and may result furthermore in the interruption of other associated machinery. These tubes are known to give a detectably different response to activation by light sources of different characteristics.

There are, however, many other applications of light sensitive components. They are widely used in other automatic ore sorters, often in combination with x-radiation fluorescence where the mineral being recovered is suitable. They are also used in seed sorters and the sorting of various suitable mineral ores, in which case the apparatus includes an ordinary light source or may rely on light of a particular colour.

An object of this invention is thus to provide a method of and apparatus for, the continuous monitoring of a photomultiplier tube or the like.

According to the invention apparatus for monitoring a light sensitive electronic detector component in use with a device for detecting light pulses of a specified character, comprising:

a light source having means adapted to direct light at a light sensitive electronic detector component, the source being operatively connected to a pulse generator which is also connected to set an alarm monitor and to operate a switch which has its input connected to the component switch output being connected to a voltage sensitive device for resetting the alarm monitor if a signal received in use from the switch is above a predetermined minimum voltage, and the alarm being adapted to activate an attention drawing device if not reset in use.

Features of the invention provide for the light pulses from the source to have the characteristic of a pulse width which is short in comparison with the pulses of a specified character or the characteristic of a pulse frequency which is high relative to the maximum frequency of the light pulses of a specified character.

Preferably the light pulses from the source have both such characteristics. Preferably the alarm monitor also activates a stopping device for stopping ancilliary equipment associated with apparatus for detecting light pulses, when the said absence is detected.

Further, the light pulses from the pulsed light source are directed at the component via a fibre optics pathway.

Further features of the invention provide for the pulse generator to be a clock pulse generator and for the switch to be an analogue switching device.

Still further, the light sensitive component response signal is pre-amplified before being connected to the analogue switching device.

There is also provided for the response signal to pass from the analogue switch to voltage sensors which are activated when the response signal reaches a predetermined threshold voltage. The threshold voltages are determined according to the desired correct response of the light sensitive component to the pulsed light source.

Preferably there are three voltage sensors, one of which is connected to deactivate the alarm control device should the response signal have a voltage above a predetermined minimum necessary threshold voltage.

The alarm signal may optionally also operate a device for deactivating any system which is dependent on the correct functioning of the component.

Yet further features of the invention provide for the apparatus to be included in known methods utilizing x-ray fluorescence techniques for the recovery of diamonds and for the ejectors used in these techniques to be monitored in a similar manner to the light sensitive component.

In accordance with this invention there is also provided apparatus for calibrating light sensitive detector components comprising:

amplitude gain control means for the amplitude response of a detector component in use;

electronic means for monitoring such amplitude response; and electronic means for adjusting the monitored amplitude gain control to produce a predetermined level of amplitude response.

There is also provided for the predetermined level of amplitude response to be determined relative to the pulse amplitude of a continuously pulsed light source provided by the above apparatus.

Preferably, for the purpose of this calibration, the other two voltage sensors are connected to adjust the gain control of the component, one of the two increasing the gain if the response signal is below a predetermined desired threshold voltage, the other of the two decreasing the gain if the response signal is above a predetermined desired maximum threshold voltage. The calibration apparatus may optionally operate continuously in use.

A preferred embodiment of the invention, described by way of example only, follows with reference to the accompanying drawing which is a block diagram showing a light sensitive electronic detector component, in the form of a photomultiplier tube, and an ejector circuit of a diamond recovery apparatus including a device for monitoring the photomultiplier tube.

In this embodiment a method and device for monitoring a photomultiplier tube for detecting fluorescing diamonds in a diamond recovery apparatus utilizing x-radiation are described.

Available apparatus of this type utilizes a photomultiplier tube 1 which converts the light from a passing fluorescing diamond into a primary electrical pulse. This pulse, which is of relatively long duration, is amplified by the amplifier indicated at 2 and is further processed before it operates an ejector valve 3 of known type.

A clock generator 4 triggers a light source 5 every second for a time duration of three micro seconds. This pulse width is small relative to that of a pulse normally detected by the cell 1 as a result of diamond fluorescence, and the frequency is higher than that of pulses so ordinarily detected.

The light pulses are conducted to the tube 1 via fibre optics 6. It will be appreciated that a plurality of photomultiplier tubes may be served from one light source by using a plurality of fibre optic tubes.

The clock generator 4 also sets an alarm monitor 7 which is conveniently a flip-flop device.

Further, the clock pulses also operate an analogue switch 8 to the input of which the output of the pre-amplifier 2 is connected.

The output of the analogue switch 8 is input to three voltage sensitive devices 9, 10 and 11. These devices are conveniently Schmitt-triggers which will each trigger if the switch output is equal or above a predetermined threshold reference voltage. The threshold voltages are provided by multiple voltage supply 12, each reference voltage being adjustable, indicated diagrammatically at 13.

Schmitt-trigger 9 has its output connected to reset flip-flop 7, which in turn activates an alarm locking device 14 if it is not reset. The alarm device 14 may operate any suitable alarm (not shown) from its output 15.

Schmitt-triggers 10 and 11 both operate on Extra High Tension (EHT) control unit 16 which in turn controls the sensitivity amplification of the photomultiplier tube 1.

The output of the pre-amplifier 2 is taken through a pulse-width discriminator or low pass filter 17 to a voltage comparator 18, which has a reference voltage from supply 19.

The output of the comparator 18 goes through a signal processing unit 20 for shaping and amplitude adjustment to an ejector drive circuit 21 which provides the ejector valve 3 with its activating signal.

The output of comparator 18 is also connected to set an ejection monitor device 22. The ejector valve has a pneumatic coupling 23 with a pressure transducer 24.

The pressure transducer resets the ejection monitor 22 if the ejector valve operates. If the ejection monitor is not reset, it is connected to operate the alarm device 14.

In normal use, a fluorescent diamond is detected by photomultiplier tube 1, the detection signal being amplified by pre-amplifier 2.

The amplified signal will pass the pulse width discriminator and low pass filter, and will cause a signal to be output by the comparator 18 if it has an amplitude greater than the comparator reference voltage from voltage supply 19.

The comparator output signal will set the ejection monitor 22.

The comparator output is processed by unit 20 and triggers the ejector drive circuit 21 which operates the ejector valve 3, and the fluorescing diamond is removed from the accompanying gangue by an air blast.

Should there be any malfunction between the comparator 18 output and the ejector, or an ejector malfunction the pressure transducer 24 will not be activated, and the ejection monitor 22 will not be reset.

An alarm signal will thus be sent to alarm device 14 which device will activate whatever alarm system is being used. Preferably the system includes means for automatically shutting down the ore sorting apparatus.

The clock generator 4 causes light pulses to be received by the photomultiplier tube 1 as described above.

The tube detection signals, after amplification at 2, are allowed to pass through the analogue switch 8 since the switch is clocked by the generator 4. The clock pulses also set alarm monitor 7.

It will be appreciated that these detection signals will not pass the pulse width discriminator and low pass filter 17 since their frequency is too high and their pulse width too narrow.

The detection signals thus pass the switch to the three voltage sensitive devices, being in this embodiment Schmitt-triggers 9, 10 and 11.

The Schmitt-trigger 9 is used to monitor the minimum amplitude of tube response that is required for correct functioning. Its reference voltage from multiple supply 12 is set at this required minimum.

If the amplitude of a detection signal is less than this minimum, the Schmitt-trigger 9 will not be activated and the alarm monitor 7 will not be reset.

This results in the monitor setting off the alarm device 14 thus giving warning that the photomultiplier tube is malfunctioning.

The Schmitt-trigger 10 and 11 provide the automatic gain control feature described above. It is desirable to have the sensitivity of amplitude response of the tube 1 to light constant within a predetermined range, since the amplitude of a detection signal is used to determine the presence of a diamond.

This range is determined by the Schmitt-triggers 10 and 11, trigger 10 detecting the maximum and 11 the minimum of the range.

If the detected signals are too low to activate Schmitt-trigger 11, it sends a control signal to EHT control Unit 16, which in turn increases the EHT supply voltage of the tube 1 until the detected signals are activating Schmitt-trigger 11.

Should the increased EHT be insufficient to increase the amplitude of the detected signals, which continue to decrease, Schmitt-trigger 9 will be activated and will operate the alarm in the manner described above.

If the detected signals are high enough to activate Schmitt-trigger 10, a control signal will be sent by the trigger to the EHT control unit and the EHT supply to the tube will be decreased.

The invention provides an efficient means of monitoring a photo multiplier tube, and in the particular application of diamond recovery as described, provides also for monitoring of the ejection apparatus and for automatic gain control of the tube.

Clearly, while the embodiment described the invention in use with only one ore sorting channel, it may be applied to a plurality of such channels.

What I claim as new and desire to secure by Letters Patent Document is:

1. Apparatus for monitoring a light sensitive electronic detector component used with a device for detecting light pulses of a specified character comprising:

a light source having means adapted to direct light at a light sensitive electronic detector component, the source being operatively connected to a pulse generator which is also connected to set an alarm monitor and to operate a switch which has its input connected to the detector component and its output connected to a voltage sensitive device for resetting the alarm monitor if a signal received from the switch is above a predetermined minimum voltage and the alarm monitor being adapted to activate an attention drawing device if not reset.

2. Apparatus as claimed in claim 1 in which the alarm monitor is adapted to activate a stopping device for stopping ancilliary equipment associated with said device, if the monitor is not reset.

3. Apparatus as claimed in claim 1 in which the means adapted to direct light is a fiber optics pathway.

4. Apparatus as claimed in claim 1 in which the light sensitive component is used in apparatus for the sorting of seeds.

5. Apparatus as claimed in claim 1 in which the light sensitive component is used in apparatus for the sorting of ores.

6. Apparatus as claimed in claim 5 in which the light sensitive component is used in a method of diamond recovery which utilizes X-radiation fluorescent techniques, including pneumatic ejection of detected fluorescing diamonds from accompanying gangue material.

7. Apparatus as claimed in claim 6 in which the light sensitive component is a photomultiplier tube.

8. Apparatus as claimed in claim 6 in which a pressure transducer is associated with a pneumatic ejector for conveying a reset signal to an alarm monitor, the monitor being connected to be set by an operating signal for the pneumatic ejector, and being adapted to activate attention drawing means if not reset.

9. In combination, a light sensitive electronic detector component forming part of a device for detecting light pulses of a specified character, apparatus for monitoring said component comprising a light source having means adapted to direct light at the light sensitive electronic detector component, the source being operatively connected to a pulse generator which is also connected to set an alarm monitor and to operate a switch which has its input connected to the detector component and its output connected to a voltage sensitive device for resetting the alarm monitor if a signal received from the switch is above a predetermined minimum voltage and the alarm monitor being adapted to activate an attention drawing device if not reset, and apparatus for calibrating the detector component comprising:

amplitude gain control means for the amplitude response of the detector component;

electronic means for monitoring such amplitude response; and electronic means for adjusting the monitored amplitude gain control to produce a predetermined level of amplitude response.

10. The combination as claimed in claim 9 in which the electronic means for monitoring the amplitude response includes two voltage sensitive devices one of which switches on receiving an amplitude response of a predetermined minimum and the other on receiving an amplitude response of a predetermined maximum, each switch being connected to operate adjusting means to maintain the amplitude gain within the said maximum and minimum.

11. Apparatus as claimed in claim 1 or 10 in which the voltage sensitive devices are Schmitt triggers.

12. A light sensitive electronic detector component forming part of a device for detecting light pulses of a specified character, in combination with apparatus for monitoring said component, the apparatus comprising:

a light source having means adapted to direct light at a light sensitive electronic detector component the source being operatively connected to a pulse generator which is also connected to set an alarm monitor and to operate a switch which has its input connected to the detector component and its output connected to a voltage sensitive device for resetting the alarm monitor if a signal received from the switch is above a predetermined minimum voltage and the alarm monitor being adapted to activate an attention drawing device if not reset.

* * * * *